US006257916B1

(12) United States Patent
Kuo

(10) Patent No.: US 6,257,916 B1
(45) Date of Patent: Jul. 10, 2001

(54) DEVICE FOR LOCKING TWO MATING CONNECTORS

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,373

(22) Filed: Dec. 29, 1999

(30) Foreign Application Priority Data

Dec. 3, 1999 (TW) ..... 88220675 U

(51) Int. Cl.[7] ..... H01R 13/627
(52) U.S. Cl. ..... 439/358; 439/378
(58) Field of Search ..... 439/350–358, 439/378–381

(56) References Cited

U.S. PATENT DOCUMENTS 5,383,794 * 1/1995 Davis et al. ..... 439/357
5,401,189 * 3/1995 Sato ..... 439/607
5,588,864 * 12/1996 Lin ..... 439/357
5,599,207 * 2/1997 Lai ..... 439/357
5,741,150 * 4/1998 Stinson et al. ..... 439/358
5,775,931 * 7/1998 Jones ..... 439/358
5,860,826 * 1/1999 Chang ..... 439/358
5,941,726 * 8/1999 Koegel et al. ..... 439/358
6,007,364 * 12/1999 Wu ..... 439/378
6,074,235 * 6/2000 Brandberg et al. ..... 439/378

* cited by examiner

*Primary Examiner*—Gary F. Paumen
(74) *Attorney, Agent, or Firm*—Wei Te Chung

(57) ABSTRACT

A locking device for joining first and second mating connectors together includes a pair of first locking members pivotably received in the first connector, a pair of guiding posts positioned beside the pair of first locking members and a pair of second locking members retained in the second connector complementary to the pair of first locking members. The pair of guiding posts smoothly guides the pair of second locking members to engage with the pair of first locking members with a portion of each second locking member being received in an opening of a corresponding first locking member thereby joining the first and second connectors together.

2 Claims, 6 Drawing Sheets

DEVICE FOR LOCKING TWO MATING CONNECTORS

BACKGROUND OF THE INVENTION

1. Field of the Invention

The present invention relates to a locking device for joining first and second mating connectors together.

2. Description of the Prior Art

Electrical connection between two mating connectors is often adversely effected by vibration or an unexpected external force. In order to protect the connection from such disturbances, the mating connectors often have engageable locking devices for securely joining the two connectors together. U.S. Pat. No. 5,401,189 and Taiwan Patent Application No. 84201383 disclose such connectors.

Referring to FIG. 5, a conventional connector comprises a dielectric housing 70, a plurality of conductive contacts 71 received in the housing 70, a shield 72 enclosing a front portion of the housing 70 and a pair of locking members 73 for joining the connector and a mating connector (not shown) together. The housing 70 defines a pair of apertures 74 in opposite sides thereof for securely receiving the corresponding locking members 73. The shield 72 defines a pair of cutouts 78 and a pair of through holes 79 at positions corresponding to the apertures 74 of the housing 70. Each locking member 73 forms a cantilevered arm 76 having a hook 77 at a free end thereof and a cavity 75 corresponding respectively to the cutout 78 and the through hole 79 of the shield 72. Each locking member 73 is received in the corresponding aperture 74 of the housing 70 with the arm 76 extending through the corresponding cutout 78 of the shield 72. The locking member 73 is attached to the housing 70 and the shield 72 by a fastening member such as a screw (not shown), extending through the cavity 75 and the through hole 79.

However, since the locking member 73 is relatively large, the aperture 74 of the housing 70 weakens the integrity of the housing 70. In addition, since the hook 77 only engages with a locking member of the mating connector (not shown) at a predetermined position, any deviation therebetween will hinder proper engagement. Further, disengagement between the two mated connectors is complicated since the locking members 73 are not provided with an accessible disengaging device. Hence, an improved electrical connector is required to overcome the disadvantages of the prior art. The co-pending application Ser. No. 09/442,105 filed Nov. 17, 1999 with the same inventor and the same assignee, discloses an approach to cure the disadvantages, while the invention performs an advanced design afterwards.

BRIEF SUMMARY OF THE INVENTION

An object of the present invention is to provide a locking device having effective guiding means and locking means for securely engaging two mating connectors together.

To fulfill the above object, a locking device for joining first and second mating connectors together comprises a pair of first locking members pivotably received in the first connector, a pair of guiding posts positioned beside the pair of first locking members and a pair of second locking members retained in the second connector complementary to the pair of first locking members. The first connector comprises an upper housing and a lower housing each respectively forming a pair of stations defining a recess. Each guiding post forms a projection block. The projection block is interferentially received in the recess of the station thereby securing the guiding post in the upper and lower housings. Each first locking member defines an opening in a head thereof and forms at least one spring arm by which the first locking member is biased to engage with the second locking member. The pair of guiding posts smoothly guides the pair of second locking members to engage with the pair of first locking members with a portion of each second locking member being received in the opening of a corresponding first locking member.

Other objects, advantages and novel features of the invention will become more apparent from the following detailed description of the present embodiment when taken in conjunction with the accompanying drawings.

DETAILED DESCRIPTION OF THE INVENTION

Figure 1:
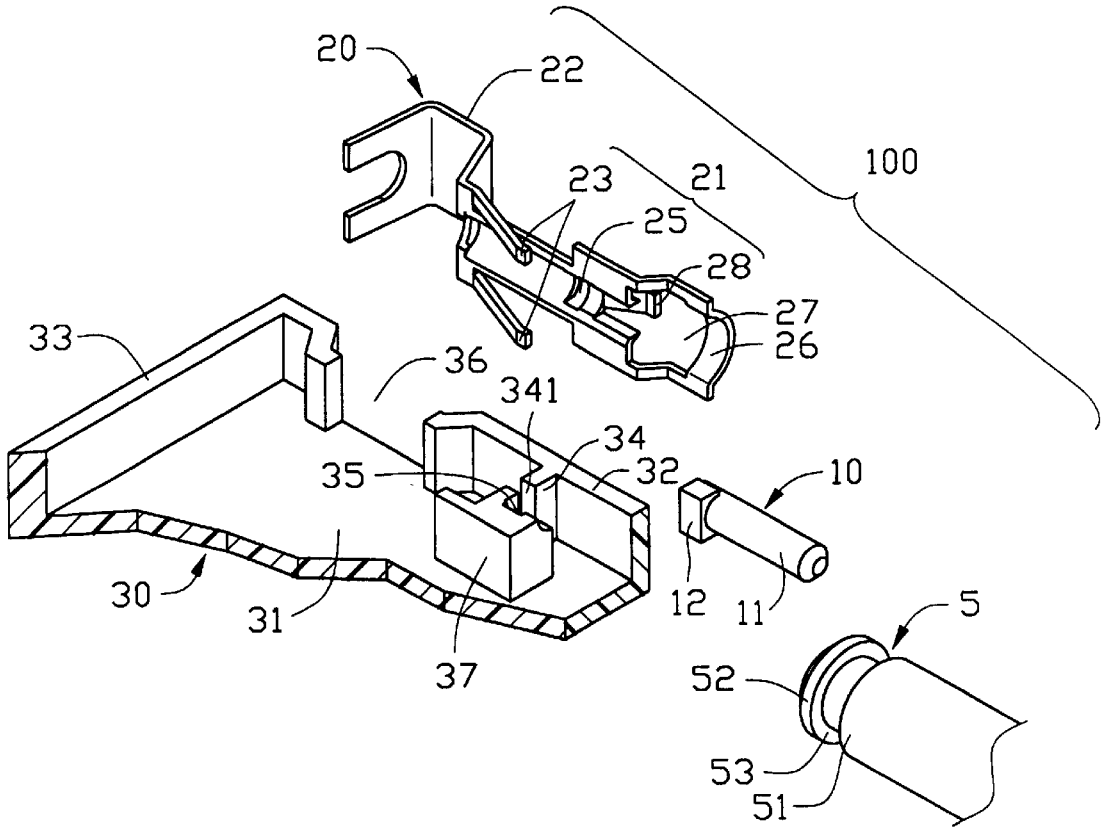
FIG. 1 is an exploded view of one locking means of the present invention and a partial section of a lower housing of a connector.
Figure 2:
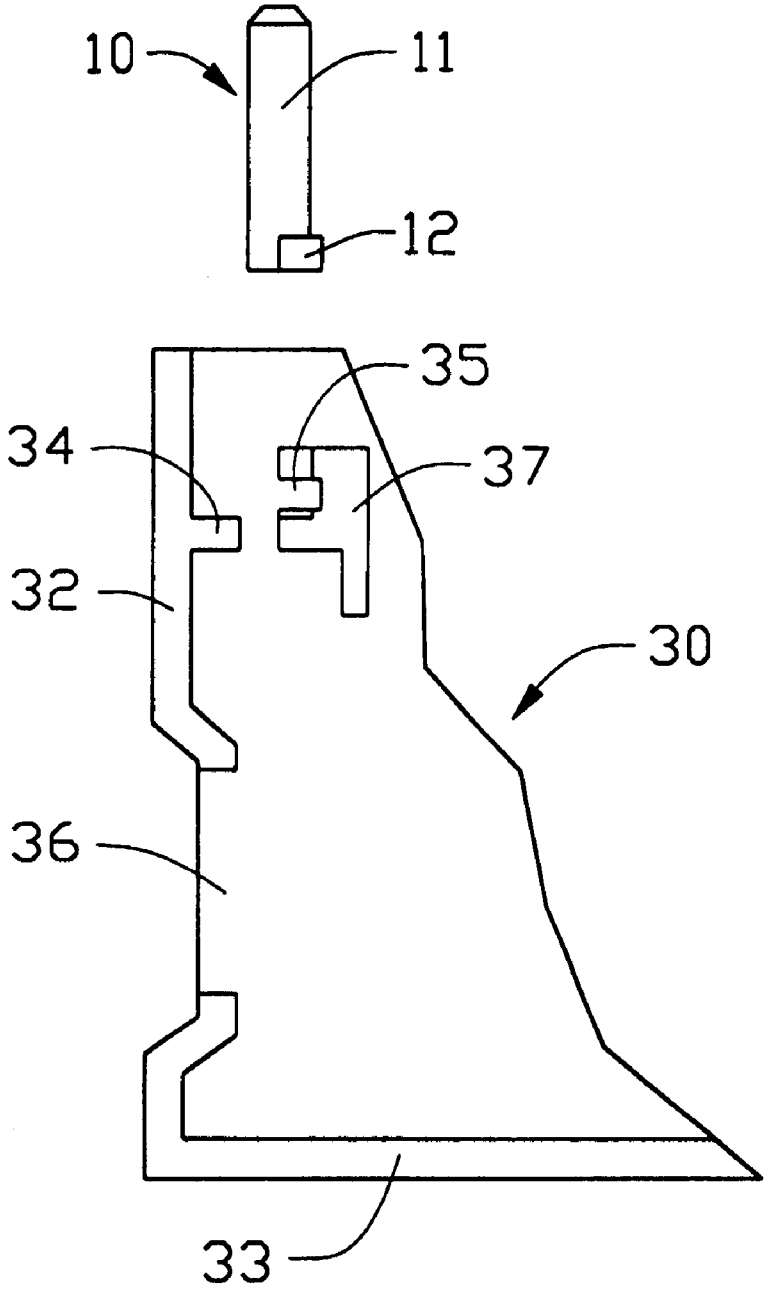
FIG. 2 is a top planar view of a guiding post of the locking means and the partial lower housing shown in FIG. 1.
Figure 3:
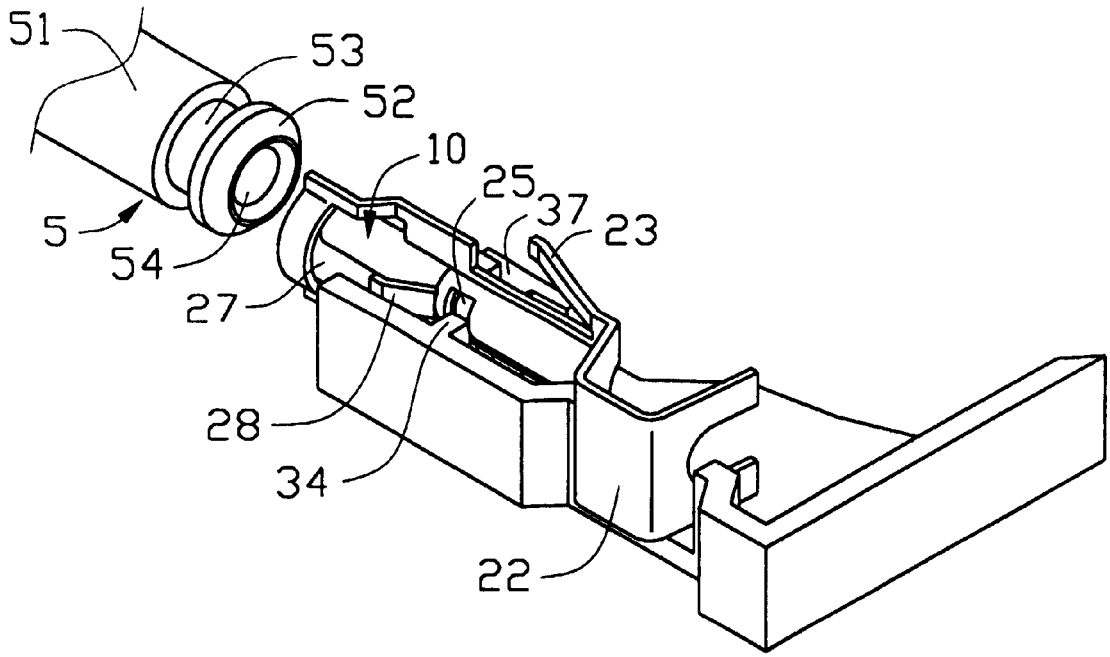
FIG. 3 is an assembled view of FIG. 1 but taken from a different perspective.

Referring to FIGS. 1–3, a locking device for joining a first connector and a second connector (not shown) together comprises a pair of locking means 100 (only one is shown). Each locking means 100 comprises a first locking member 20 pivotably received in one of the opposite sides of the first connector, a guiding post 10 positioned beside the first locking member 20 and a second locking member 5 fixedly received in the second connector with respect to the first locking member 20. The first connector comprises an upper housing (not shown) and a lower housing 30 coupling together. The upper and the lower housings generally have the same configuration therefore only the lower housing 30 is illustrated. The lower housing 30 comprises a bottom portion 31, a pair of side walls 32 (only one is shown) and a rear wall 33 upwardly extending from the bottom portion 31. Each side wall 32 defines a window 36 adjacent to the rear wall 33 for manually operating the first locking member 20. The lower housing 30 further forms a block 34 inwardly extending from each side wall 32 which is spaced a predetermined distance from the rear wall 33. A station 37 is positioned beside each block 34 and defines a recess 35 therein.

Each guiding post 10 comprises a pole 11 and a projection block 12 positioned at a rear end of the pole 11. Each first locking member 20 comprises a main portion 21 defining an opening 27 in a head 26 thereof and a press portion 22 for manually operating the first locking member 20 to pivot relative to the guiding post 10. The main portion 21 comprises a pair of first spring arms 23 laterally extending away from the main portion 21 and a second spring arm 28 laterally extending in a direction opposite to the direction of extension of the first spring arms 23. The first and second spring arms 23, 28 offset a predetermined distance from each other along the main portion 21. The main portion 21 defines a slot 25 in a generally middle portion thereof functioning as a pivot about which the first locking member 20 pivots. The press portion 22 is generally U-shaped for facilitating manual operation of the first locking member 20.

Each second locking member 5 comprises a retention portion 51 generally retained in the second connector, an expanded portion 52 opposing the retention portion 51 and a recessed portion 53 between the retention portion 51 and the expanded portion 52. The recessed portion 53 has a smaller dimension than the expanded portion 52. The second locking member 5 defines a hole 54 therein which has a slightly greater diameter than the pole 11 of the guiding post 10.

In assembly, the guiding post 10 and the first locking member 20 are collected together. Two assemblies of the guiding post 10 and the first locking member 20 are then positioned in each of the two opposite sides of the upper and lower housings of the first connector. The projection block 12 of the guiding post 10 is interferentially received in the recess 35 of the station 37. The press portion 22 of the first locking member 20 partially extends out of the lower housing 30 through the window 36. The slot 25 accommodates a top corner 341 of the block 34. The first spring arms 23 and the second spring arm 28 resiliently abut against the station 37 and the side wall 32, respectively whereby the head 26 of the main portion 21 of the first locking member 20 is biased to move toward the pole 11 of the guiding post 10.

Figure 4A:
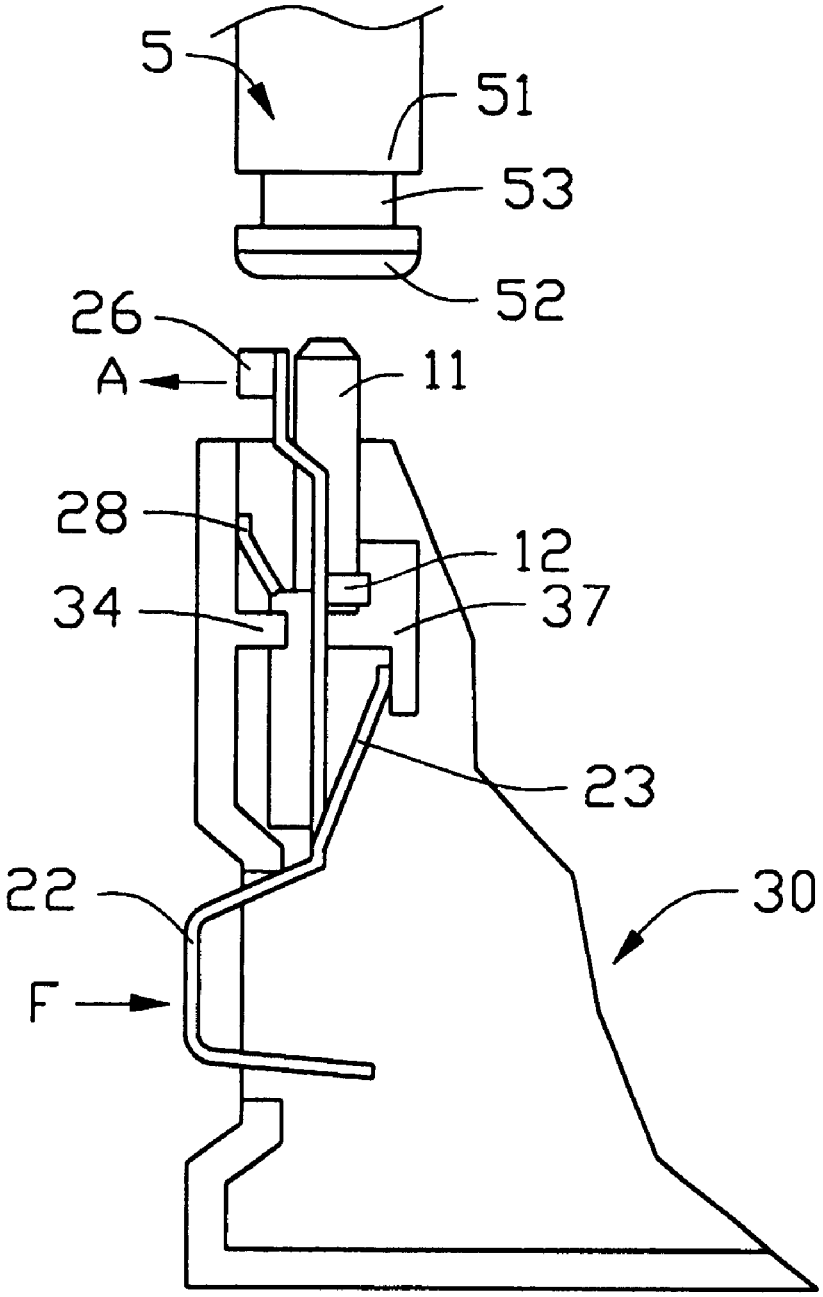
FIGS. 4A–4C are top planar views of FIG. 3 sequentially illustrating the process of the first and second locking members mating together with the guidance of the pair of guiding posts.
Figure 4B:
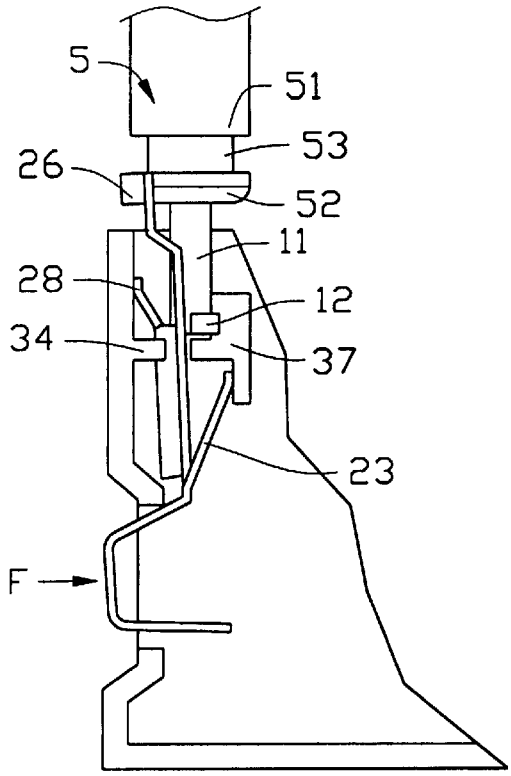
Figure 4C:
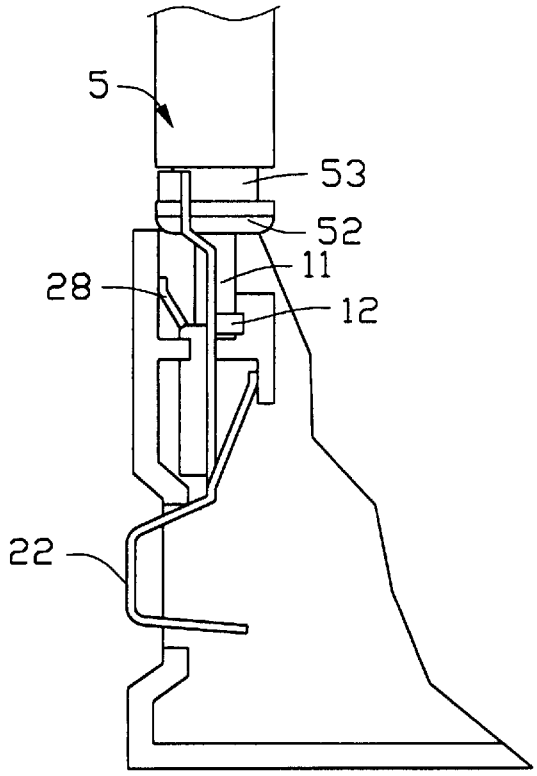
Figure 5:
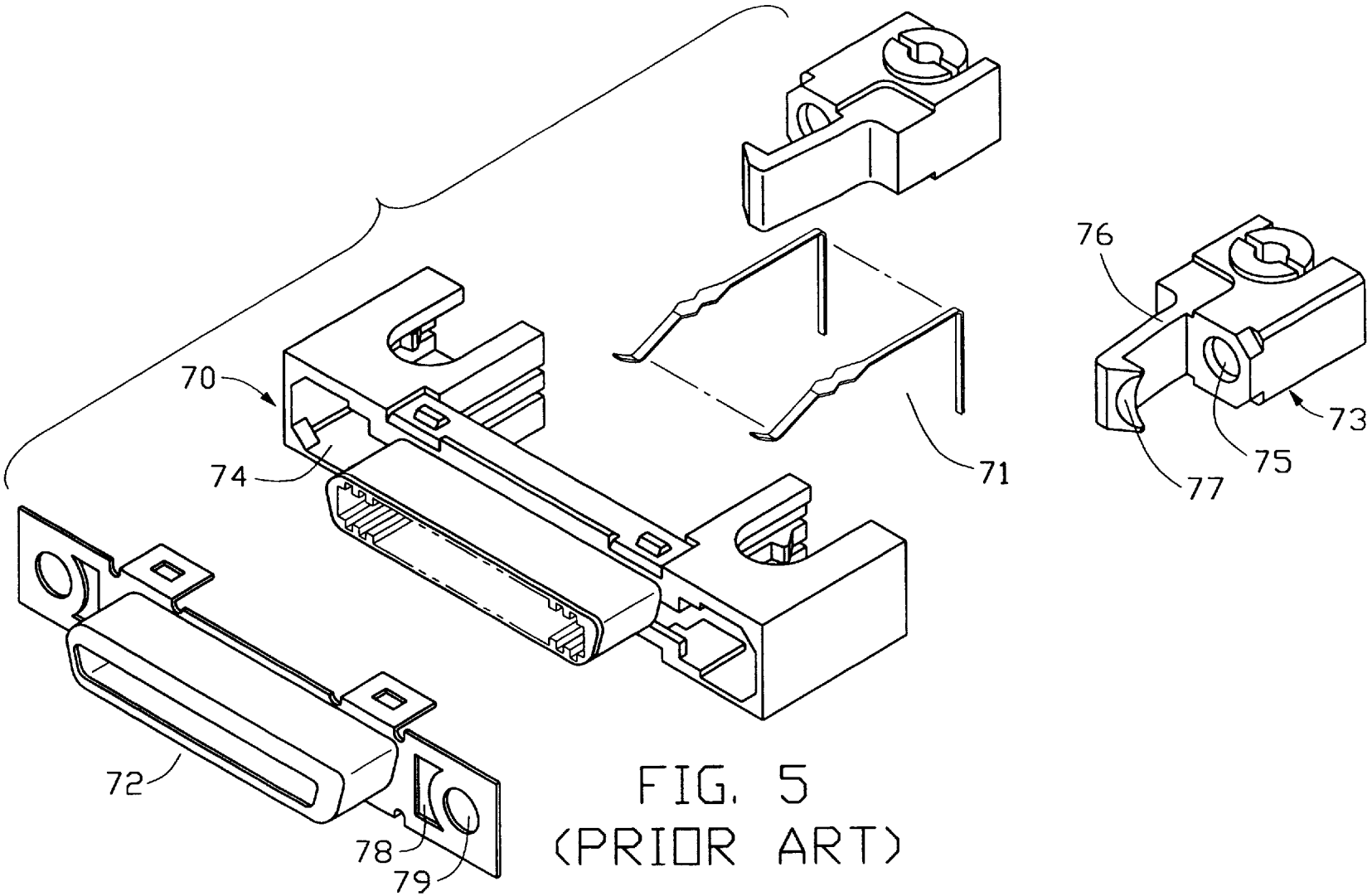
FIG. 5 (PRIOR ART)
FIG. 5 is an exploded view of a pair of conventional locking means and an electrical connector.

In operation, referring to FIGS. 4A–4C, when the first connector is mating to the second connector, a force F is exerted on the press portion 22 of each first locking member 20 to pivot the first locking member 20 around the top corner 341 of the block 34 in a direction indicated by arrow A (named the "A direction" hereinafter) whereby the head 26 of the first locking member 20 moves away from the pole 11 of the guiding post 10. The first connector and the first locking members 20 move toward the second connector and the second locking members 5 therefore the poles 11 are slidably received in the holes 54 of the second locking members 5 and the heads 26 of the first locking members 20 slide over the expanded portions 52 of the second locking members 5. When the first connector is fully mated with the second connector, the force F is removed from the press portions 22 and the first locking members 20 pivot in a direction opposite to the "A direction" due to the function of the first and second spring arms 23, 28, whereby the heads 26 move toward the expanded portions 52 of the second locking members 5. The opening 27 of each first locking member 20 accommodates a corresponding expanded portion 52 of each second locking member 5 and the head 26 abuts against the recessed portion 53 thereby engaging the first locking member 20 and the second locking member 5 together. Because of the guidance of the guiding posts 10, the first and the second locking members 20 and 5 are properly engaged together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device joining first and second mating connectors together, comprising:

a pair of first locking members pivotably received in the first connector, each first locking member having a head and an opening defined in the head;

a pair of guiding posts each being securely positioned beside a corresponding first locking member; and a pair of second locking members retained in the second connector, the pair of second locking members being aligned with and smoothly guided by the pair of guiding posts to engage with the pair of first locking members, a portion of each second locking member being received in the opening of a corresponding first locking member;

wherein each guiding post comprises a projection block adapted for being secured in the first connector;

wherein each first locking member comprises at least one laterally extending spring arm for biasing the head to move toward the guiding post;

wherein each first locking member defines a slot in a generally middle portion thereof functioning as a pivot point about which the first locking member pivots.

2. An electrical connector assembly comprising:

an upper housing and a lower housing coupled together, at least one of the upper and the lower housings comprising a pair of stations;

a pair of first locking members pivotably received between the upper and the lower housings and being adjacent to the pair of stations; and a pair of guiding posts each being interferentially positioned between a corresponding first locking member and the adjacent station;

wherein each guiding post comprises a projection block and each station defines a recess, the projection block being interferentially received in a corresponding recess thereby retaining the guiding post in the upper and lower housings;

wherein each fist locking member defines a slot in a generally middle portion thereof, and wherein at least one of the upper and lower housings forms a block, the block being received in the slot and functioning as a pivot point about which the first locking member pivots;

wherein each first locking member comprises at least one laterally extending spring arm for biasing a head of the first locking member to move toward the guiding post.

* * * * *